United States Patent [19]

Clement

[11] 4,453,433

[45] Jun. 12, 1984

[54] GEAR WRENCH HAVING ADJUSTMENT TO ASSURE PROPER MESHING

[76] Inventor: Burke Clement, 7823 Gleason Rd., Westview Towers, Apt. 1214, Knoxville, Tenn. 37919

[21] Appl. No.: 257,917

[22] Filed: Apr. 27, 1981

[51] Int. Cl.[3] ..... B24B 17/00

[52] U.S. Cl. ..... 81/57.29

[58] Field of Search ..... 81/57.29, 57.13, 57.14

[56] References Cited

U.S. PATENT DOCUMENTS 4,242,931 1/1981 Clement ..... 81/57.29

FOREIGN PATENT DOCUMENTS

Ad.10159 of 1904 United Kingdom ..... 81/57.29

105599 4/1917 United Kingdom ..... 81/57.29

*Primary Examiner*—James L. Jones, Jr.

*Attorney, Agent, or Firm*—Pitts, Ruderman & Kesterson

[57] ABSTRACT

An improved gear wrench which is particularly adapted for tightening or loosening nuts or bolts in tight places. The gear wrench comprises an elongated first member which carries at one of its ends a housing which rotatably receives a gear wheel therein. A tubular member is secured along its length to the first member and rotatably receives an elongated shaft which includes one end portion which extends beyond the corresponding end portion of the tubular member and is disposed proximate the gear wheel carried by the housing. A pinion gear is secured to this end portion of the shaft and includes teeth which mesh with the teeth of the gear wheel such that upon rotation of the shaft, a corresponding rotation is imparted to the gear wheel and a stud carried thereon which is adapted for receiving a suitable conventional socket. The teeth on the gear wheel and the surface of the gear wheel serve to define a recess which receives the end portion of the socket which is assembled on the stud. The recess serves to control the size of the socket which can be mounted on the wrench to assist in matching the strength of the wrench with the work done by it.

6 Claims, 7 Drawing Figures

Fig. 5
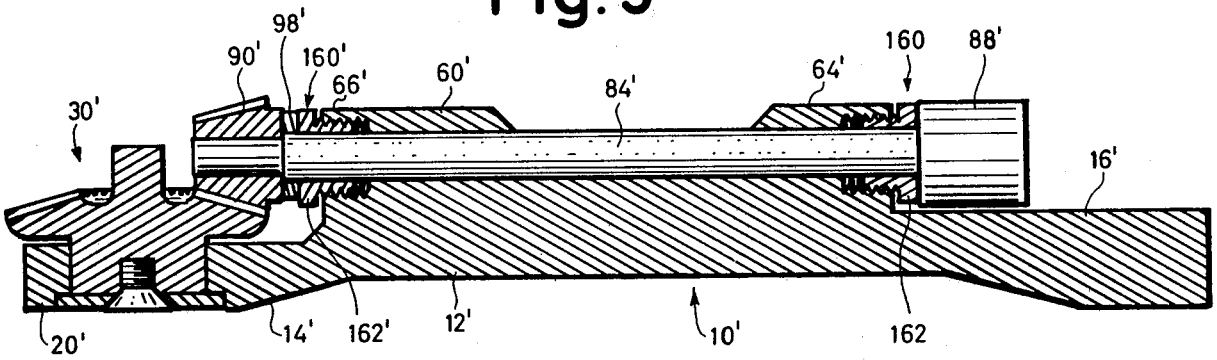
Fig. 6
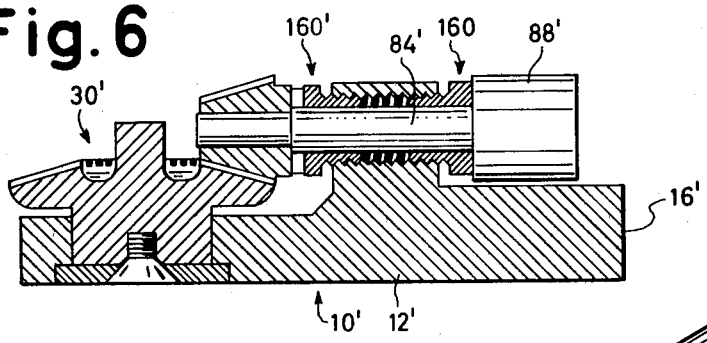
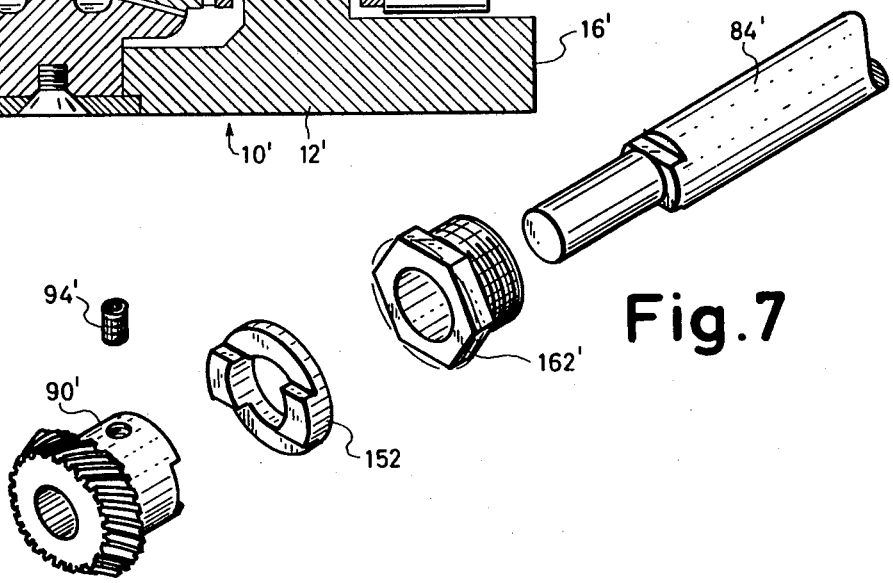
Fig. 7

GEAR WRENCH HAVING ADJUSTMENT TO ASSURE PROPER MESHING

DESCRIPTION

1. Technical Field

This invention relates to a gear wrench and more particularly concerns a wrench which includes adjustment bushings to assure proper meshing between the pinion and the driven gear.

2. Background Art

In certain mechanical operations, it may be necessary or desired to remove a nut, bolt or the like from an area where it is difficult to manipulate the wrench in a conventional manner. For example, in certain locations where it is desired to remove a nut from a bolt, mechanical apparatuses surrounding the nut form obstacles which may impede or prevent rotation of a conventional wrench about the axis of the nut. Heretofore, it has been known to utilize wrenches which incorporate a gear drive for purposes of turning a socket which engages the nut or bolt to facilitate loosening or tightening a nut or bolt in tight places. Examples of prior art wrenches employing gear drives are disclosed in U.S. Pat. No. 4,003,275 and U.S. Pat. No. 4,242,931 which issued to the present inventor.

Known prior art gear wrenches suffer certain disadvantages, however. For example, after continued use for an extended period, the teeth between the pinion or driving gear and the driven gear can become misaligned. This is normally due to a change in the position at which the pinion gear is carried due to worn parts, such as hub of the gear.

It is therefore an object of this invention to provide an improved gear drive wrench for loosening and tightening nuts and bolts, particularly nuts and bolts in tight places. It is another object of the invention to provide a gear drive wrench which includes means for adjusting the position at which the pinion gear is maintained to assure proper meshing of the pinion gear and the driven gear wheel teeth.

Another object of the invention is to provide a drive gear mounting assembly which reduces the wear on the drive gear hub.

DISCLOSURE OF THE INVENTION

Accordingly, a gear wrench is provided which includes a first member which is preferably elongated and carries a housing at one of its end portions. A driven gear is rotatably mounted on the housing and includes a gear wheel which defines a substantially planar surface circumscribed by a plurality of gear teeth disposed at spaced locations about the perimeter of its surface. A stud extends substantially perpendicularly from the central portion of the surface. A tubular member which is carried by the first member defines an elongated opening therethrough which rotatably receives an elongated shaft. The shaft has one end portion which carries a pinion gear having teeth which mesh with the teeth of the gear wheel such that the rotation of the shaft imparts rotational forces to the gear teeth of the gear wheel thereby rotating the stud and any socket mounted thereon. At least one adjustment bushing is provided to assure that the teeth of the pinion gear mesh with the teeth of the driven gear after continued use of the wrench for an extended period.

BRIEF DESCRIPTION OF THE DRAWINGS

Other objects and advantages of the invention will become apparent upon reading the following detailed description together with the drawings wherein:

FIGS. 5, 6 and 7 illustrate an embodiment of a wrench incorporating adjustment bushings which position the pinion gear for proper tooth alignment.

BEST MODE FOR CARRYING OUT THE INVENTION

Figure 1:
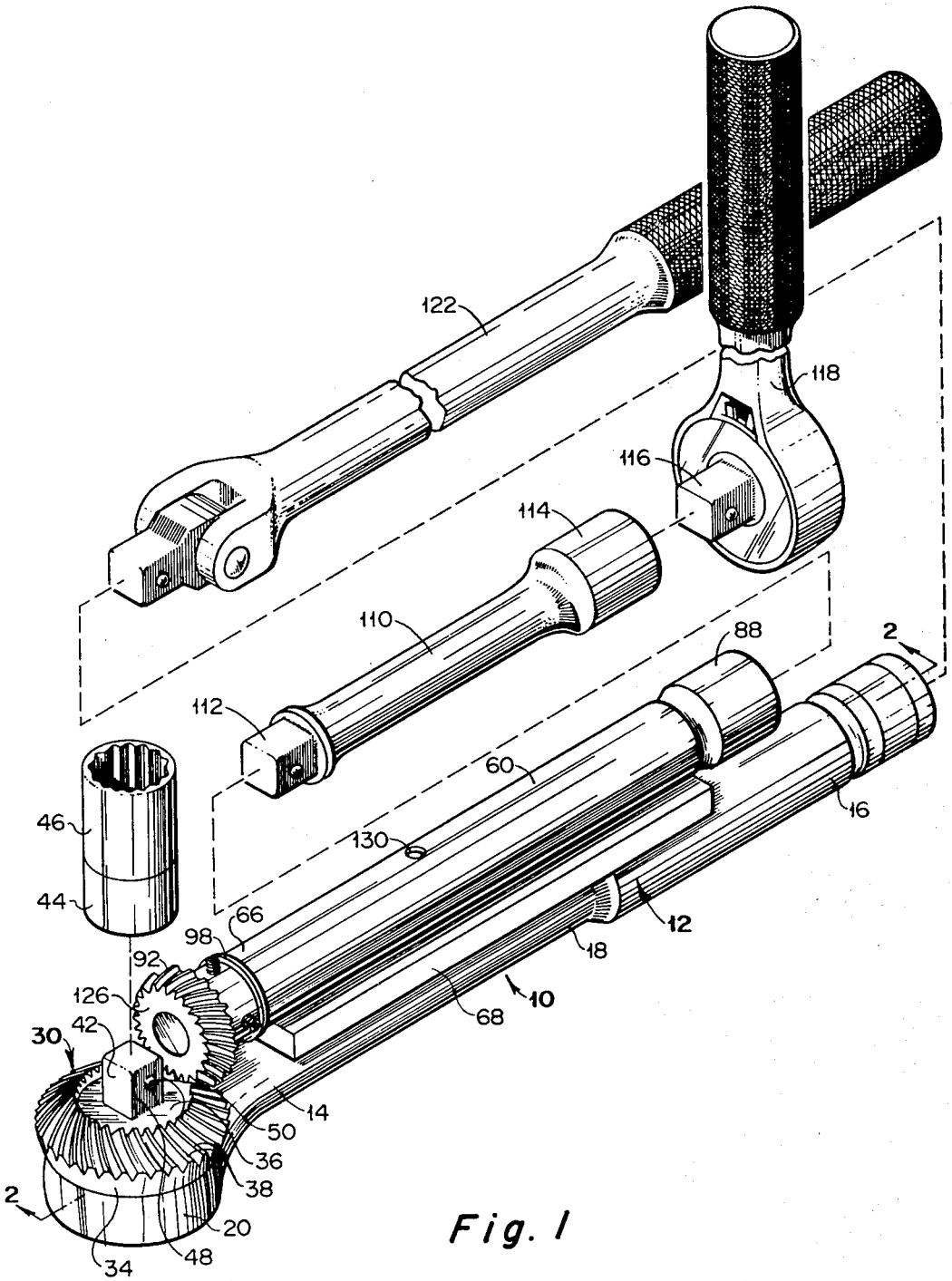
FIG. 1 is a perspective view of an improved gear wrench incorporating various features of the invention.

Referring now to the drawings, an improved gear wrench is indicated generally at 10. This gear wrench is particularly adapted for loosening or tightening a nut or bolt positioned in a tight location, however, the wrench can also be used for loosening or tightening a nut or bolt in a conventional manner. Moreover, the wrench 10 is also designed to be used as necessary or desired, as one member of a set of wrenches each of which is adapted for receiving sockets having a diameter less than a predetermined value.

The illustrated wrench 10 includes a first member 12 which is fabricated from a substantially rigid material such as case hardened steel. This first member 12 is elongated and includes a first end portion 14 and a further end portion 16. The midportion 18 of the first member 12 is tapered from a larger cross section to a smaller section as shown in FIG. 1, to facilitate gripping the wrench and manipulating the wrench in an area having surrounding obstacles.

The end portion 14 of the member 12 carries a housing 20 which is adapted for rotatably receiving one of the gears. More specifically, the illustrated housing 20 is substantially circular in outline and integrally formed with the end portion 14 of the member 12. This housing 20 defines a bore 22 which opens at one of its ends on the surface 24 of the housing. The opposite end of the bore 22 opens on the surface 26 of the housing which forms a substantially planar surface that continues along a portion of the length of the member 12 as illustrated at 28 in FIG. 2.

A driven gear 30 is rotatably mounted on the housing 20 carried by the end portion 14 of the member 12. This driven gear 30 includes a substantially cylindrical hub portion 32 which is rotatably received within the bore 22 of the housing 20. As necessary or desired, to facilitate rotational movement of the driven gear 30 within the housing during operation of the wrench, a suitable bearing may be interposed between the cylindrical surface of the gear hub 32 and the surface of the housing which defines the bore 22. In normal applications, it has been found satisfactory, however, to eliminate the cost of the bearing and utilize direct contact between the hub surface and the surface of the housing defining the bore, provided suitable lubrication is interposed between these surfaces to attenuate the frictional forces.

The illustrated hub 32 is integrally formed with a gear wheel indicated at 34. The illustrated gear wheel 34 defines a substantially planar surface 36 which is circumscribed by a plurality of gear teeth 38. More specifically, the gear teeth in the illustrated embodiment are disposed about the perimeter of the surface 36 at predetermined locations. These gear teeth as shown in FIG. 1 are spiral and mesh with a further set of gear teeth as will be described in greater detail hereinafter.

A stud 42 extends substantially perpendicularly from the central portion of the surface 36. This stud 42 is substantially rectangular in outline and is adapted for receiving a similarly proportioned opening defined in the end portion 44 of a conventional socket 46. Surface 48 of the stud 42 is provided with a conventional spring biased pin 50 which assists in securing the conventional socket 46 on the stud 42.

One feature of the present invention is to provide a gear wrench which limits the size of the socket which can be mounted on the wrench such that the strength of the gears and/or wrench will not be exceeded during tightening or loosening a nut upon which the socket is assembled. To this end, a recess 52 having a predetermined diameter is defined at its base by the surface 36 and along its side wall by the end portions 54 of the teeth 38 which are disposed about the perimeter of the surface 36. It will be recognized that the diameter of the socket which is completely assembled on the wrench will be controlled by the diameter of the recess 52, inasmuch as the end portion 44 of the socket is received within the recess upon mounting the socket on the stud 42. To this end, when the socket is placed in its assembled position on the wrench, the end surface defined proximate the end portion 44 of the socket engages the surface 36 of the gear wheel. A socket having a diameter less than the diameter of the recess 52 can be readily mounted on the stud 42 provided that the stud and the opening defined in the end portion 44 of the socket are proportioned for mating. However, a socket having an external diameter greater than the diameter of the recess 52 cannot be mounted on a wrench since the end portion 44 of the socket cannot be received within a recess 52 having a lesser diameter. By controlling the diameter of the socket which is mounted upon the wrench, the strength of the gears and/or wrench can be matched with the size of the nut or bolt to be tightened or loosened to assist in assuring that an unskilled or inattentive mechanic will not inadvertently exceed the strength of the wrench as by trying to tighten or loosen a large bolt with a relatively small wrench.

A bearing tube or tubular member 60, fabricated from a suitable rigid material such as case hardened steel, is carried by the elongated member 12. More specifically, the illustrated tubular member is substantially cylindrical and defines an elongated bore 62 therethrough. This tubular member 60 includes a first end portion 64 which is disposed proximate the end portion 16 of the member 12. The opposite end portion 66 of the tubular member 60 is positioned proximate the housing 20 and the end portion 14 of the member 12. In the depicted embodiment a suitable spacer 68 is interposed between the member 12 and the tubular member 60 for purposes of positioning the tubular member at a predetermined location for reasons which will become more apparent hereinafter. The illustrated spacer 68 is elongated and substantially rectangular in outline and is joined along its lower surface 70 to the substantially flat surface 28 of the member 12 as by welding. The upper surface 72 of the spacer 68 is joined to the wall 74 of the tubular member and in this connection, the portion of the wall 74 of the tubular member 60 which is secured to the spacer 68 as by welding may be machined to define a flat surface to enhance the strength of the weld.

As illustrated in the Figures, the spacer 68 includes one end portion 76 which abuts a shoulder 78 defined at the end portion 16 of the member 12. The opposite end portion 80 of the spacer 68 terminates at a spaced location from the gear wheel 30 to prevent the spacer 68 from interfering with the rotation of the gear wheel. It will be recognized, that the tubular member and member 12 together with the spacer can be integrally formed as necessary or desired.

An elongated shaft 84 is rotatably received within the bore or opening 62 defined in the tubular member 60. This shaft 84 is substantially circular in cross section and of a length greater than the length of the tubular member 60 such that the opposite end portions 86 and 88 of the shaft extend beyond the associated end portions of the tubular member. More specifically, the end portion 86 of the shaft 84 is disposed proximate the teeth of the gear wheel 30.

A gear pinion 90 is mounted on the end portion 86 of the shaft 84 and includes teeth 92 which mesh with the teeth 38 of the gear wheel. In the embodiment shown in FIG. 1, the teeth of the gear pinion or drive gear are spiral and of the opposite hand from the teeth of the gear wheel. Spiral gears enhance the force applied for turning the nut or bolt desired to be loosened or tightened. To secure the gear pinion 90 on the shaft, a suitable set screw 94 is threadably received within an internal threaded bore defined in the hub portion 96 of the gear pinion. As necessary or desired a plurality of set screws may be provided at annularly spaced locations for joining the gear pinion and the end portion 86 of the shaft.

The end portion 86 the shaft 84 is positioned proximate the socket 46 when the socket is assembled on the wrench. Moreover, the surface 126 of the pinion gear 90 is disposed proximate the socket 46 mounted on the wrench. It will be recognized that the recess 52, the end portion of the socket and the pinion gear, or more specifically, the end surface 126 of the pinion gear, can each serve as means for controlling the size of the socket mounted on the wrench. Thus, with a conventional socket having a cylindrical external wall if the distance between the central axis of the stud 42 and the wall of the recess 52 defined by the gear wheel teeth is less than the distance between the end portion 84 of the shaft or the end surface 126 of the gear 90, the recess 52 will control the size of the gear capable of being mounted on the wrench. Similarly, the distance between the central axis of the shaft and the end surface 126 of the pinion gear can be made less than the distance from the central axis of the stud 42 to the recess wall or to the end portion 86 of the shaft 84 such that this distance controls the socket size. Also, the distance between the central axis of the stud 42 and the end portion of the shaft 84 can be made such that this distance controls the size of the socket mounted on the wrench.

To assist in attenuating the forces which tend to separate the teeth of the gear pinion 90 and the teeth of the gear wheel 30 during operation of the wrench, a thrust washer 98 is interposed between the end surface 82 of the gear pinion hub 96 and the end portion 66 of the tubular member 60. This thrust washer 98 is of conventional design and defines, substantially at its central portion, an opening which rotatably receives the shaft 84 therethrough. Moreover, the thrust washer 98 serves as a shield to assist in preventing the hand on an operator from inadvertently moving into contact with the gears when gripping the control handle, i.e. the handle defined by member 60 and the member 12.

The end portion 88 of the shaft 84 is flared as shown in the figures and defines a recess 102 which is adapted for receiving the shaft or stud of means adapted for applying rotational forces to the shaft. One suitable means for applying rotational driving forces to the shaft 84 is shown in FIG. 1 which depicts an extension 110 including at one of its end portions, a stud 112 adapted for being inserted in the recess 102. The opposite end portion 114 of the extension defines a further recess which is adapted for receiving the shaft or stud 116 of a conventional ratchet wrench 118. It will be recognized that through the use of the illustrated wrench, and as necessary or desired, the extension 110, the ratchet can be rotated at a location remote to the location of the nut or bolt desired to be manipulated. Thus, the ratchet or other suitable driving tool can be applied and rotated at a location which is free of obstacles. The end portion 88 of the shaft can be of various shapes to facilitate engaging the shaft for purposes of applying driving forces thereto. For example, the shaft end portion 88 could be manufactured such that it is square in cross-section to facilitate gripping it with a conventional wrench or the like.

It will be recognized that the rotating shaft 84 held by the bearing tube or tubular member 60 which serves to drive the working socket 46, is disposed substantially parallel and adjacent to the control handle or member 12. The spacer 68 is interposed between these members as necessary or desired, and has a thickness which is determined by the size of the gears. The members 60 and 12, however, can be integrally formed or formed separately and joined as by welding with a thickness such that the spacer is unnecessary.

Figure 2:
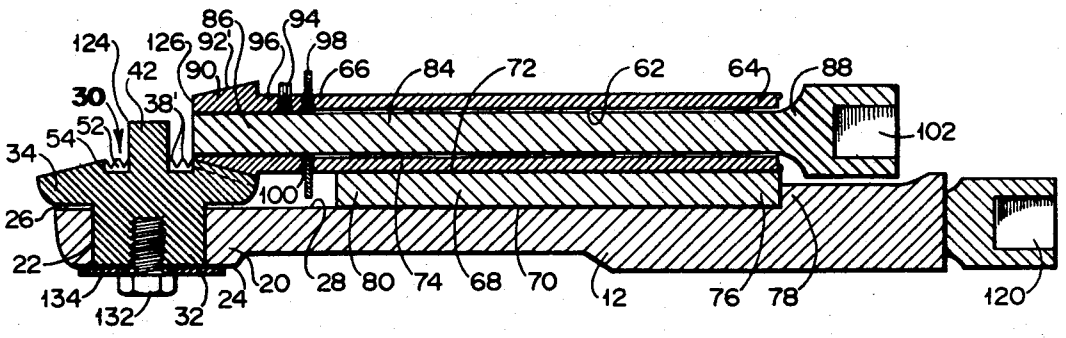
FIG. 2 is sectional view of the wrench taken along line 2—2 of FIG. 1, with alternate gears being employed.

The engagement between the gear pinion and the gear wheel maintains the hub of the gear 30 within the housing bore 22 during operation of the wrench. As necessary or desired, the gear wheel 30 can be more firmly secured within the housing by a suitable bolt 132 whose shaft is secured with a suitable internally threaded bore provided in the hub as shown in FIG. 2. A conventional washer 134 is interposed between the bolt head, and the hub and wrench housing. This washer is proportioned for engaging at its perimeter, the portion of the housing surrounding the bore end opening on housing surface 24. It will be recognized that the washer is not fastened against the housing by the bolt, but instead is allowed to rotate freely with the hub while maintaining the perimeter of the gear wheel against surface 28 of member 12.

A further feature of the invention is to provide a wrench such that the female attaching members or recess 102 and 120 are fully integrated with the extensions, ratchets and break bars found in a conventional socket set used by a mechanic and are adapted for being attached to an electrical or air driven impact wrench. The female attaching members of the control handle or member 12 and the rotating shaft 84 which define the recesses 120 and 102 respectively, can be effectively extended through the use of extensions, break bars or the like such that the rotational forces can be applied to the shaft 84, and the wrench can be gripped at a location which is substantially free of obstacles. Still further, the spacer 68 serves to position the shaft 84 at a spaced location from the member 12 to facilitate applying rotational forces to the end 88 of the shaft as with a ratchet 118 or with a ratchet combined with an extension 110.

As shown in the Figures, the member 12 includes an end portion 16 which extends beyond the end portion 88 of the shaft 84. This end portion 16 facilitates gripping the wrench directly during tightening or loosening operations. Moreover, the end portion 16, is adapted for engaging a suitable tool which can be gripped at a more remote location. As necessary or desired, however, the tubular member 60 and/or the shaft end portion 88 can extend beyond the end portion 16 of the member 12.

Figure 3:
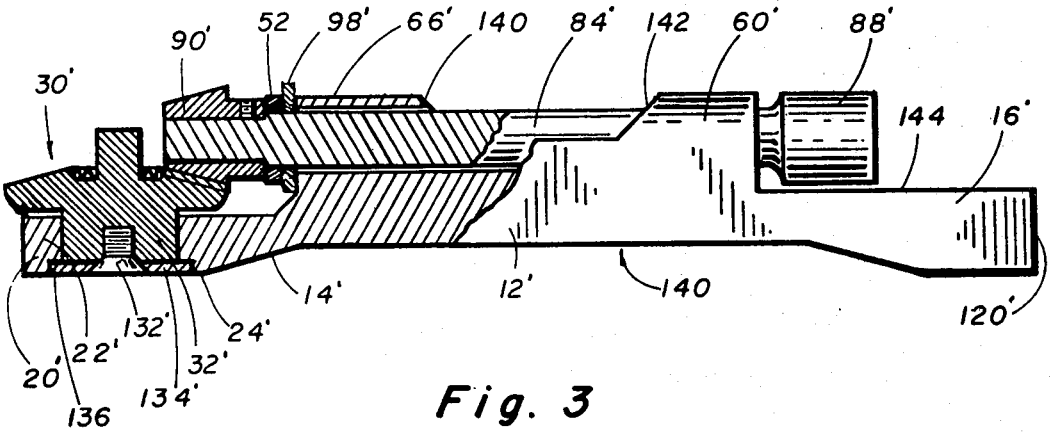
FIG. 3 is a sectional side elevation view of an alternate embodiment of a gear wrench constructed in accordance with various features of the invention.
Figure 4:
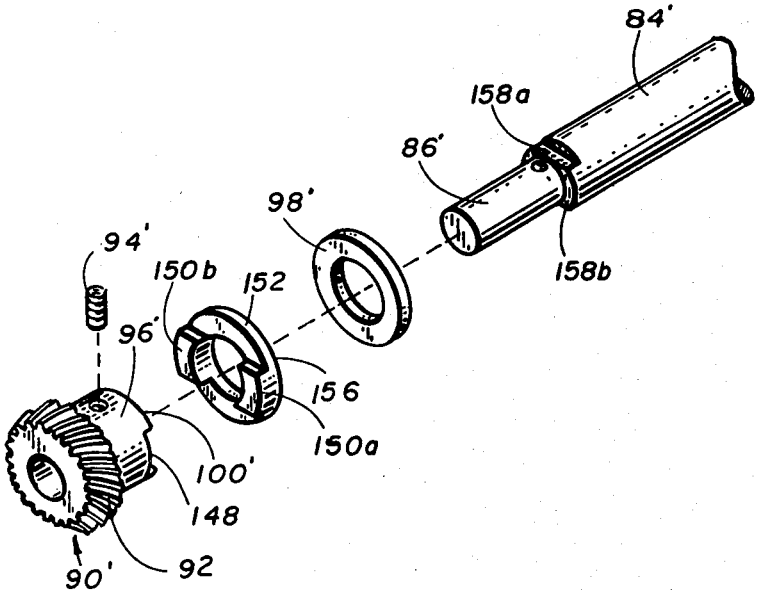
FIG. 4 is an exploded view of the driving gear mounting assembly.

An alternate embodiment of the invention is illustrated in FIGS. 3 and 4. This alternate embodiment incorporates a unitary frame 140 comprising a first frame member 12' fabricated from a substantially rigid material such as case hardened steel. The frame member 12' is elongated and includes a first end portion 14' and a further end portion 16'. The end portion 14' carries a housing 20' which is adapted for rotatably receiving the hub 32' of the driven gear 30'. As shown, this hub 32' of the driven gear is received in the bore 22' defined by the housing 20' which opens at one of its ends on the surface 24' of the housing. As shown in FIG. 3, the end portion of the bore 22' opening on the surface 24' of the housing is of increased diameter to receive the washer 134' therein. This washer is recessed into the housing bore such that the surface 136 of the washer is substantially flush with the surface 24' of the housing. Thus, the wrench is made more compact and requires less space for operation. Moreover, the washer rotatably secures the gear 30' in the housing, and to this end, the screw 132' is employed. It will be noted in FIG. 3 that the head surface of the metal screw 132' is received within the bore of the washer and the bore of the hub such that this head surface is substantially coplanar with the surface 136 of the washer and the surface 24' of the housing.

The first frame or base member 12' of the unitary frame 140 is integrally formed with the tubular member or bearing 60' which serves to rotatably receive the shaft 84'. The bearing 60' extends along a section of the length of the base member 12' from end portion 14' which defines the housing to a spaced location from the tip 138 of the further end portion 16'. The tip 138 of the base member is provided with a female coupling or recess 120', similar to the recess 120 as shown in FIG. 2, to assist in providing torque control, as by connecting with the mating male end portion of a suitable break bar.

In the embodiment depicted in FIGS. 3 and 4, the bearing member is slotted between the locations indicated at 140 and 142 to reduce the weight and material required to manufacture the frame. This slotting of the bearing facilitates lubricating the shaft 84' inasmuch as a section of the shaft is exposed. However, the spacing between the shaft and bearing 60' is kept minimal, to prevent pinching the operator's skin between the bearing and the shaft during rotation thereof.

As shown in FIG. 3, the end portion 88' of the shaft 84' is positioned above the substantially flat surface 144 of the end portion 16' of the base member 12'. This end portion 88' is provided with a recess for mating with a suitable stud for applying driving forces to the shaft.

An alternate driving gear mounting assembly 146 is provided for mounting the pinion gear 90' (See FIGS. 3 and 4) on the end portion 86' of the shaft 84'. More specifically, the gear mounting assembly 146 includes a pinion gear which includes a hub portion 96' having slots 148 which receive the shoulders 150*a* and 150*b* of the shouldered washer 152. These shoulders fit into the gear hub slots such that the shouldered washer turns with the gear so that all wear is on the opposite surface or full bearing surface 156 of the shouldered washer 152. Thus, the bearing surface is effectively increased reducing the likelihood of wearing the gear out.

As shown in FIGS. 3 and 4, the gear 90' is mounted on the reduced diameter tip portion 86' of the shaft 84'. The sections of the gear hub between the slots 148 engage the flattened surfaces 158*a* and *b* of the shouldered down section of the tip to prevent rotation of the gear with respect to the shaft. In the embodiment illustrated in FIGS. 3 and 4, the set screw 94' assists in preventing longitudinal movement of the gear with respect to the shaft. The thrust washer 98' is interposed between the shouldered washer and the end portion 66' of the bearing such that the bearing surface of the shouldered washer engages the thrust washer. Accordingly, the wear caused by rotation and operation of the wrench is absorbed by the shouldered washer instead of the gear.

As shown in FIG. 3, the thrust washer 98' serves as means for shielding the gears from the hand of an operator and to this end the diameter of the thrust washer is increased to stop the operator's hand from slipping into the gears and being injured. It will be noted that the unitary frame at the head portion of the wrench is fabricated such that the shielding thrust washer is readily accommodated.

Thus, means are provided for positioning the pinion gear 90' at a preselected location such that the teeth of this pinion gear form a proper mesh with the teeth of the driven gear 30'. More specifically, after continued wear, the hub portion of the pinion gear will rub against the juxtaposed end portion of the tubular member 60' or the washer 152 will rub against this end portion of the tubular member. After a period of time, this frictional engagement between the pinion gear or the washer and the end portion of the tubular member will cause the pinion gear to be free to move a direction along the longitudinal axis of the tubular member. This motion can result in a misalignment of the teeth of the pinion gear and the teeth of the driven gear 30'. To assist in assuring the proper alignment and meshing of the teeth of the pinion gear and the teeth of the driven gear, adjustment bushings 160 and 160' are provided at the end portions 64' and 66' of the tubular member 60'. More specifically, each of the adjustment bushings in the illustrated embodiment is threadably received within the internally threaded and corresponding end portion of the tubular member. Each bushing can be adjusted along the length of the internally threaded portions of the tubular member such that the effective length of the tubular member is variable. The end portion 162 of the adjustment bushing 160 and the end portion 162' of the adjustment bushing 160' is provided with geometric shape in the illustrated embodiment to facilitate gripping the adjustment bushings with a conventional wrench. In this connection, the geometric shape of the end portion of the bushing in FIGS. 5 and 7 are hexagonal.

In the embodiment illustrated in FIG. 7, the bushing is used in conjunction with the shouldered washer 152 which mates with the hub portion of the pinion gear 90'.

More specifically, the flat surface at the end portion of the bushing which is engaged by a wrench, frictionally engages the mating flat surface of the shouldered washer, such that the pinion gear is shielded from the frictional wear.

In the embodiment depicted in FIG. 6, the shaft 84' and the housing 60' are foreshortened such that the opposed end portions of each of the adjustment bushings are positioned proximate each other within the opening defined in the tubular member into which the further end portions of each of the adjustment bushings are variablly advanced. In this embodiment of the wrench, tighter locations can be operated in. Also, it will be noted that in this embodiment that the end portion of the member 12' can be recessed from or overhang the end portion 88' of the shaft. This end portion 88' of the shaft is fabricated such that it has an increased cross-sectional outline and defines a recess (not shown) which is adapted for receiving a tool designed for applying rotational forces to the shaft.

From the foregoing detailed description and drawings, it will be recognized that an improved gear wrench has been described and illustated which incorporates various advantges over known prior art wrenches. More specifically, the gear wrench 10 is inexpensive to manufacture and assemble and incorporates adjustment bushings which readily position the pinion or drive gear at a position for proper meshing with the driven gear.

It is understood that although a preferred embodiment of the present invention has been illustrated and described, various modifications thereof will become apparent to those skilled in the art, and accordingly, the scope of the present invention is defined by the appended claims and equivalents thereof.

I claim:

1. An improved gear wrench for use in manipulating bolts and similar threaded members, particularly in confined locations, which comprises:

an elongated body member having first and further end portions;

a housing carried by said first end of said body member, said housing defining a cylindrical bore having an axis substantially perpendicular to said body member;

a driven gear rotatably mounted within said bore of said housing, said driven gear defining a substantially planar surface circumscribed by a plurality of radially extending teeth;

a stud extending substantially perpendicularly from said planar surface along said axis of said bore, said stud providing for releasable attachment for wrench units;

a shaft supporting member having first and further end portions carried by said body member, said shaft supporting member provided with an elongated cylindrical passageway having an axis substantially parallel with said body member;

an elongated shaft rotatably received within said passageway, said shaft having first and further end portions, said first and said further end portions of said shaft extending beyond said first and said further end portions of said shaft-supporting member, said first end portion of said shaft terminating proximate said teeth of said driven gear;

a pinion gear secured to said first end portion of said shaft, said pinion gear including radially extending teeth which mesh with said teeth of said driven gear whereby rotation of said shaft imparts rotational movement to said driven gear and said stud;

a driving hub secured to said further end portion of said shaft for receiving rotary input means for rotating said shaft;

a first adjustment bushing encircling said shaft received within said passageway proximate said first end portion of said shaft supporting member, said first adjustment bushing provided with a first end portion which engages said pinion gear and a second end portion which engages said passageway and provides for axial movement of said first adjustment bushing;

a further adjustment bushing encircling said shaft received within said passageway proximate said further end portion of said shaft supporting member, said second adjustment bushing provided with a first end portion which engages said driving hub and a second end portion which engages said passageway and provides for axial movement of said second adjustment bushing;

whereby said first and further adjustment bushings provide for precise axial movement of said shaft and said pinion gear to achieve correct mesh of said teeth of said pinion gear with said teeth of said driven gear.

2. The gear wrench of claim 1 wherein said first and said further adjustment bushings are threadably received within said first and said further end portion of said shaft supporting member, respectively, such that the effective length of said shaft supporting member can be adjusted thereby providing means for positioning said pinion gear at a preselected location such that said teeth of said pinion gear properly mesh with said teeth of said driven gear.

3. The gear wrench of claim 1 wherein the first end portions of said first and further adjustment bushings define a geometric configuration suitable for being engaged by a wrench such that the effective length of said shaft supporting member can readily be adjusted.

4. The gear wrench of claim 3 wherein said first and further adjustment bushings each define a first end portion having a plurality of edges suitable for being engaged by a wrench and wherein said further end portions of said adjustment bushings each define an external thread and wherein said first and further end portions of said passageway define internal threads which readily receive said further end portions of said adjustment bushings whereby said adjustment bushings can be selectively advanced or withdrawn from said shaft supporting member for adjusting the position of said gear pinion.

5. The gear wrench of claim 4 wherein said shaft supporting member, said shaft and said body member are foreshortened such that opposed further end portions of said first and further adjustment bushings are positioned proximate each other thereby enabling placement of said wrench in said confined locations.

6. The gear wrench of claim 5 in which said foreshortened shaft supporting member overhangs said foreshortened body member.

* * * * *